US010096294B2

(12) United States Patent
Kim et al.

(10) Patent No.: US 10,096,294 B2
(45) Date of Patent: Oct. 9, 2018

(54) GATE DRIVING CIRCUIT AND DISPLAY DEVICE INCLUDING THE SAME

(71) Applicant: SAMSUNG DISPLAY CO., LTD., Yongin-si, Gyeonggi-do (KR)

(72) Inventors: Jonghee Kim, Yongin-si (KR); Kyoungju Shin, Hwaseong-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/478,446

(22) Filed: Apr. 4, 2017

(65) Prior Publication Data

US 2017/0287427 A1 Oct. 5, 2017

(30) Foreign Application Priority Data

Apr. 5, 2016 (KR) ..... 10-2016-0041853

(51) Int. Cl.
*G09G 3/36* (2006.01)

(52) U.S. Cl.
CPC ..... *G09G 3/3677* (2013.01); *G09G 3/3688* (2013.01); *G09G 3/3696* (2013.01); *G09G 2310/0248* (2013.01); *G09G 2310/0294* (2013.01); *G09G 2310/08* (2013.01); *G09G 2330/021* (2013.01)

(58) Field of Classification Search
CPC .. G09G 3/3677; G09G 3/3674; G09G 3/3696; G09G 2310/0294; G09G 2310/08; G09G 2330/021
See application file for complete search history.

(56) References Cited

U.S. PATENT DOCUMENTS

| | | | | |
|---|---|---|---|---|
| 9,071,230 | B2 | 6/2015 | Kim et al. | |
| 9,087,468 | B2 | 7/2015 | Yoon et al. | |
| 9,294,086 | B2 | 3/2016 | Kwon et al. | |
| 9,479,156 | B2 | 10/2016 | Kwon et al. | |
| 9,524,674 | B2 | 12/2016 | Kwon et al. | |
| 9,524,690 | B2 | 12/2016 | Lim et al. | |
| 2015/0187323 | A1* | 7/2015 | Jin | G09G 5/003 345/215 |

(Continued)

FOREIGN PATENT DOCUMENTS

| | | | |
|---|---|---|---|
| KR | 10-1250158 | B1 | 3/2013 |
| KR | 10-2015-0031899 | A | 3/2015 |

(Continued)

*Primary Examiner* — Lixi C Simpson
(74) *Attorney, Agent, or Firm* — Lee & Morse, P.C.

(57) ABSTRACT

A gate driving circuit includes multiple stages to provide gate signals to gate lines of a display panel. At least one stage includes first and second input circuits and output circuit, discharge circuit, pull down circuit, and hold circuit. The first input circuit delivers a (k−2)th gate signal to a first node. A second input circuit delivers a (k+1)th gate signal to the first node. The output circuit outputs a first clock signal as a k-th gate signal based on the first node. The discharge circuit discharges a second node based on the (k−2)th gate signal. The pull down circuit discharges the first node based on the second node and (k+2)th gate signal and discharges the k-th gate signal based on the second node and a (k+2)th gate signal. The hold circuit delivers a (k+3)th gate signal to the second node and maintains the signal level of the second node.

18 Claims, 8 Drawing Sheets

(56) References Cited

U.S. PATENT DOCUMENTS

| | | | | |
|---|---|---|---|---|
| 2015/0263722 | A1 | 9/2015 | Kim et al. | |
| 2015/0287392 | A1 | 10/2015 | Kim et al. | |
| 2015/0288364 | A1* | 10/2015 | Lin | H03K 19/00384 377/75 |
| 2015/0358018 | A1 | 12/2015 | Kim et al. | |
| 2016/0086562 | A1* | 3/2016 | Tan | G09C 3/3677 345/215 |
| 2016/0203762 | A1 | 7/2016 | Kim et al. | |
| 2016/0203783 | A1 | 7/2016 | Kim et al. | |
| 2016/0203786 | A1 | 7/2016 | Lim et al. | |
| 2016/0210890 | A1 | 7/2016 | Lim et al. | |
| 2016/0210920 | A1 | 7/2016 | Kim et al. | |
| 2016/0218707 | A1 | 7/2016 | Park et al. | |
| 2016/0267831 | A1 | 9/2016 | Seo et al. | |
| 2017/0140729 | A1* | 5/2017 | Sueki | G11C 19/28 |

FOREIGN PATENT DOCUMENTS

| | | | |
|---|---|---|---|
| KR | 10-2015-0086771 | A | 7/2015 |
| KR | 10-2016-0089937 | A | 7/2016 |
| KR | 10-2016-0100084 | A | 8/2016 |
| KR | 10-2016-0117707 | A | 10/2016 |
| KR | 10-2016-0119300 | A | 10/2016 |
| KR | 10-2017-0020591 | | 2/2017 |

* cited by examiner

GATE DRIVING CIRCUIT AND DISPLAY DEVICE INCLUDING THE SAME

CROSS-REFERENCE TO RELATED APPLICATION

Korean Patent Application No. 10-2016-0041853, filed on Apr. 5, 2016, and entitled: "Gate Driving Circuit and Display Device Including the Same," is incorporated by reference herein in its entirety.

BACKGROUND

1. Field

One or more embodiments disclosed herein relate to a gate driving circuit and a display device including a gate driving circuit.

2. Description of the Related Art

A display device includes pixels connected to gate lines and data lines. A gate driving circuit sequentially provides gate signals to the gate lines, and data driving circuit outputs data signals to the data lines. The gate driving circuit may include a shift register and a number driving stages. The driving stages output gate signals that correspond to the gate lines. Each of the driving stages may include organically-connected transistors.

SUMMARY

In accordance with one or more embodiments, a gate driving circuit including a plurality of stages to provide gate signals to gate lines of a display panel, wherein a k-th stage (k being a natural number greater than or equal to 2) from among the stages includes: a first input circuit to receive a (k−2)th gate signal from a (k−2)th stage and deliver the (k−2)th gate signal to a first node; a second input circuit to receive a (k+1)th gate signal from a (k+1)th stage and deliver the (k+1)th gate signal to the first node; an output circuit to output a first clock signal as a k-th gate signal based on a signal of the first node; a discharge circuit to discharge a second node as a voltage based on the (k−2)th gate signal; a pull down circuit to discharge the first node as the voltage based on a signal of the second node and a (k+2)th gate signal from a (k+2)th stage and discharge the k-th gate signal as the voltage based on the signal of the second node and a (k+2)th gate signal from a (k+2)th stage; and a hold circuit to receive a (k+3)th gate signal from a (k+3)th stage, deliver the (k+3)th gate signal to the second node, and maintain a signal level of the second node for a predetermined time.

The first input circuit may include a first input transistor which includes a first electrode connected to a first input terminal to receive the (k−2)th gate signal, a second electrode connected to the first node, and a gate electrode connected to the first input terminal. The second input circuit may include a first input transistor comprising a first electrode connected to a second input terminal to receive the (k+1)th gate signal, a second electrode connected to the first node, and a gate electrode connected to the second input terminal.

The discharge circuit may include a discharge transistor which includes a first electrode connected to the second node, a second electrode connected to a voltage terminal to receive the voltage, and a gate electrode connected to a first input terminal to receive the (k−2)th gate signal.

The pull down circuit may include a first pull down transistor including a first electrode connected to the first node, a second electrode connected to a voltage terminal to receive the voltage, and a gate electrode connected to a third input terminal for receiving the (k+3)th gate signal; a second pull down transistor including a first electrode connected to the first node, a second electrode connected to the voltage terminal, and a gate electrode connected to the second node; a third pull down transistor including a first electrode connected to a gate output terminal to output the k-th gate signal, a second electrode connected to the voltage terminal, and a gate electrode connected to a fourth input terminal to receive the (k+2)th gate signal; and a fourth pull down transistor including a first electrode connected to the gate output terminal a second electrode connected to the voltage terminal, and a gate electrode connected to the second node.

The hold circuit may include a hold transistor including a first electrode connected to a third input terminal to receive the (k+3)th gate signal, a second electrode connected to the second node, and a gate electrode connected to the third input terminal; and a capacitor connected to the second node and a voltage terminal to receive the voltage. The hold circuit may include a first hold transistor including a first electrode connected to a third input terminal to receive the (k+3)th gate signal, a second electrode, and a gate electrode connected to the third input terminal; a second hold transistor including a first electrode connected to the second electrode of the first hold transistor, a second electrode connected to the second node, and a gate electrode connected to the second electrode of the first hold transistor; and a capacitor connected to the second node and a voltage terminal to receive the voltage.

In accordance with one or more other embodiments, a display device includes a display panel including a plurality of pixels respectively connected to a plurality of gate lines and a plurality of data lines; a gate driving circuit including a plurality of stages to output gate signals to the gate lines; and a data driving circuit to drive the data lines, wherein a k-th stage among the stages (k is a positive integer greater than 1) includes: a first input circuit to receive a (k−2)th gate signal from a (k−2)th stage and deliver the (k−2)th gate signal to a first node; a second input circuit to receive a (k+1)th gate signal from a (k+1)th stage and deliver the (k+1)th gate signal to the first node; an output circuit to output a first clock signal as a k-th gate signal based on a signal of the first node; a discharge circuit to discharge a second node as a voltage based on the (k−2)th gate signal; a pull down circuit to discharge the first node as the voltage based on a signal of the second node and a (k+2)th gate signal from a (k+2)th stage and discharge the k-th gate signal as the voltage based on the signal of the second node and a (k+2)th gate signal from a (k+2)th stage; and a hold circuit to receive a (k+3)th gate signal from a (k+3)th stage, deliver the (k+3)th gate signal to the second node, and maintain a signal level of the second node for a predetermined time.

The gate driving circuit may include a first gate driving circuit including a plurality of first stages to output the gate signals to a first group of gate lines among the gate lines; and a second gate driving circuit including a plurality of second stages to output the gate signals to a second group of gate lines among the gate lines. The first gate driving circuit and the second gate driving circuit may be at different sides of the display panel.

A first group of first stages among the first stages may operate based on a first clock signal, and a second group of first stages among the first stages may operate based on a second clock signal complementary to the first clock signal. A group of second stages among the second stages may operate based on a third clock signal, a second group of second stages among the second stages may operate based on a fourth clock signal complementary to the third clock signal; and the first clock signal and the second clock signal may have different phases.

The first input circuit may include a first input transistor which includes a first electrode connected to a first input terminal to receive the (k−2)th gate signal, a second electrode connected to the first node, and a gate electrode connected to the first input terminal. The second input circuit may include a first input transistor which includes a first electrode connected to a second input terminal to receive the (k+1)th gate signal, a second electrode connected to the first node, and a gate electrode connected to the second input terminal.

The discharge circuit may include a discharge transistor which includes a first electrode connected to the second node, a second electrode connected to a voltage terminal to receive the voltage, and a gate electrode connected to a first input terminal for receiving the (k−2)th gate signal.

The pull down circuit may include a first pull down transistor including a first electrode connected to the first node, a second electrode connected to a voltage terminal to receive the voltage, and a gate electrode connected to a third input terminal for receiving the (k+3)th gate signal; a second pull down transistor including a first electrode connected to the first node, a second electrode connected to the voltage terminal, and a gate electrode connected to the second node; a third pull down transistor including a first electrode connected to a gate output terminal to output the k-th gate signal, a second electrode connected to the voltage terminal, and a gate electrode connected to a fourth input terminal to receive the (k+2)th gate signal; and a fourth pull down transistor including a first electrode connected to the gate output terminal, a second electrode connected to the voltage terminal, and a gate electrode connected to the second node.

The hold circuit may include a hold transistor including a first electrode connected to a third input terminal to receive the (k+3)th gate signal, a second electrode connected to the second node, and a gate electrode connected to the third input terminal; and a capacitor connected to the second node and a voltage terminal to receive the voltage. The hold circuit may include a first hold transistor including a first electrode connected to a third input terminal for receiving the (k+3)th gate signal, a second electrode, and a gate electrode connected to the third input terminal; a second hold transistor including a first electrode connected to the second electrode of the first hold transistor, a second electrode connected to the second node, and a gate electrode connected to the second electrode of the first hold transistor; and a capacitor connected to the second node and a voltage terminal to receive the voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
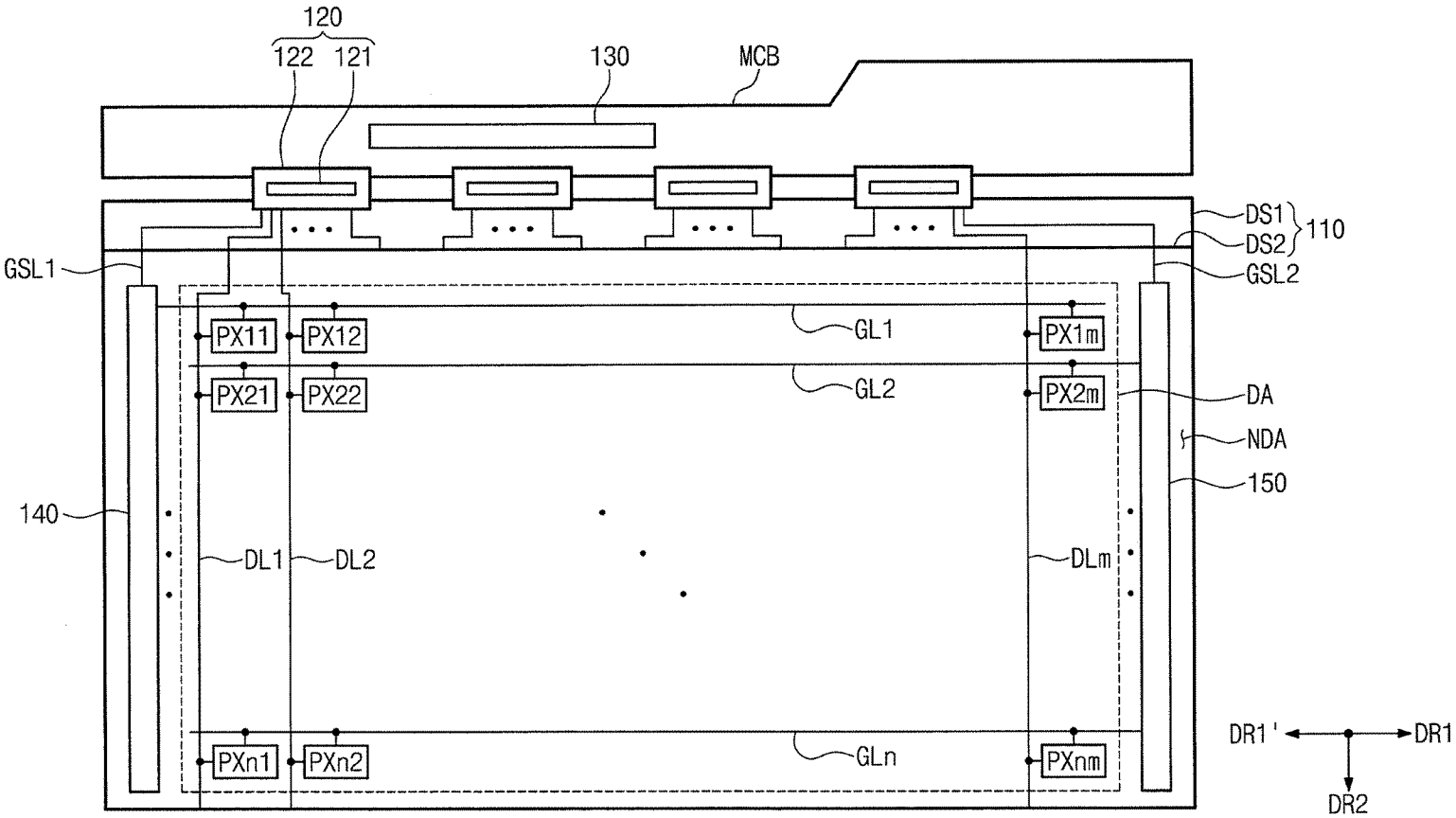
FIG. 1 illustrates an embodiment of a display device.

Example embodiments will be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments, or certain aspects thereof, may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2:
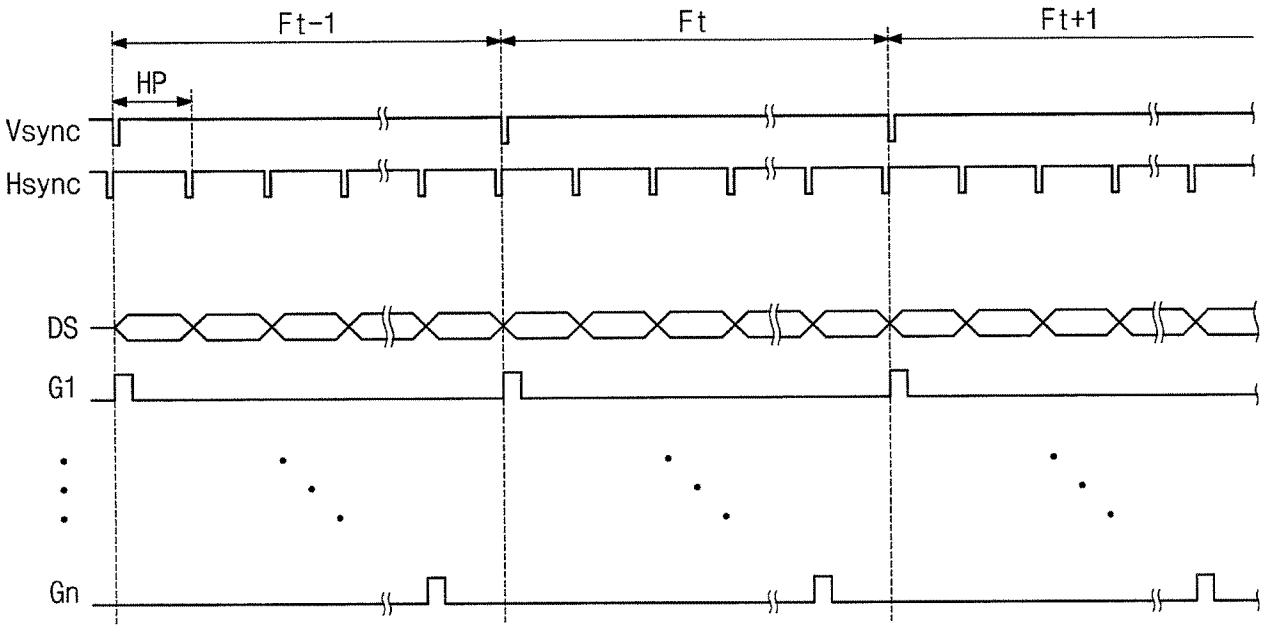
FIG. 2 illustrates an embodiment of signals for controlling the display device.

FIG. 1 illustrates an embodiment of a display device, and FIG. 2 is a timing diagram illustrating an embodiment of signals for controlling the display device. Referring to FIGS. 1 and 2, the display device includes a display panel 110, a data driving circuit 120, a driving controller 130, and a gate driving circuit. The gate driving circuit includes a first gate driving circuit 140 and a second gate driving circuit 150. The display panel 110 may be, for example, as a liquid crystal display panel, an organic light emitting display panel, an electrophoretic display panel, and an electrowetting display panel. The display panel 110 is described as a liquid crystal display panel for illustrative purposes only. In one embodiment, the liquid crystal display panel may optionally include a polarizer and also includes a backlight unit.

The display panel 110 includes a liquid crystal layer LCL between a first substrate DS1 and a second substrate DS2. The display panel 110 includes a display area DA including a plurality of pixels PX11 to PXnm and a non-display area NDA surrounding the display area DA.

The display panel 110 includes a plurality of gate lines GL1 to GLn on the first substrate DS1 and a plurality of data lines DL1 to DLm intersecting the gate lines GL1 to GLn. A first group of the gate lines GL1, GL3, . . . , GLn−1 extend from the first gate driving circuit 140 in a first direction DR1 and a second group of the gate lines GL2, GL4, . . . , GLn extend from the second gate driving circuit 150 in a third direction DR1'. The data lines DL1 to DLm extend in a second direction DR2 from the data driving circuit 120. For illustrative purposes, only some of the gate lines GL1 to GLn and only some of the data lines DL1 to DLm are illustrated in FIG. 1.

Only some of the pixels PX11 to PXnm are illustrated in FIG. 1. The pixels PX11 to PXnm are connected to corresponding ones of the gate lines GL1 to GLn and corresponding ones of the data lines DL1 to DLm.

The pixels PX11 to PXnm may be arranged in a plurality of groups based on the color of light emitted. The pixels PX11 to PXnm display a predetermined combination of light color, e.g., red, green, blue, and white or yellow, cyan, magenta.

The data driving circuit 120, the first gate driving circuit 140, and the second gate driving circuit 150 receive a control signal from the driving controller 130. The driving controller 130 may be mounted on a main circuit board MCB. The driving controller 130 receives image data and control signals from, for example, an external graphic control unit. The control signals may include vertical sync signals Vsync for distinguishing frame sections Ft−1, Ft, and Ft+1, horizontal sync signals Hsync for distinguishing horizontal sections HP (e.g., row distinction signals), and data enable signals, and clock signals. The data enable signals may be, for example, at a high level only during a section where data is output to display a data incoming area.

The first gate driving circuit 140 generates gate signals G1, G3, . . . , Gn−1 based on a control signal (gate control signal) from the driving controller 130 through a signal line GSL1 during the frame sections Ft−1, Ft, and Ft+1 and outputs the generated gate signals G1, G3, . . . , Gn−1 to the gate lines GL1, GL3, . . . , GLn−1. The second gate driving circuit 150 generates gate signals G2, G4, . . . , Gn based on a control signal (gate control signal) from the driving controller 130 through a signal line GSL2 during the frame sections Ft−1, Ft, and Ft+2 and outputs the generated gate signals G2, G4, . . . , Gn to the gate lines GL2, GL4, . . . , GLn.

The gate signals GI to Gn may be sequentially output in correspondence to the horizontal sections HP. The first gate driving circuit 140 and the second gate driving circuit 150 and the pixels PX11 to PXnm may be formed simultaneously through a thin film process. For example, the first gate driving circuit 140 and the second gate driving circuit 150 may be mounted as an Oxide Semiconductor TFT Gate driver circuit (OSG) in the non-display area NDA. The first gate driving circuit 140 is at one side of the display area DA and the second gate driving circuit 150 is at the other side of the display area DA. The first gate driving circuit 140 and the second gate driving circuit 150 may face each other based on the center (or another predetermined reference area) of the display area DA.

The data driving circuit 120 generates grayscale voltages according to image data from the driving controller 130 based on a control signal (data control signal) from the driving controller 130. The data driving circuit 120 outputs the grayscale voltages as data voltages DS to the data lines DL1 to DLm.

The data voltages DS may include positive data voltages having a positive value with respect to a common voltage and/or negative data voltages having a negative value with respect to the common voltage. Some of data voltages applied to the data lines DL1 to DLm have a positive polarity and others have a negative polarity during each of the horizontal sections HP. The polarity of the data voltages DS may be inverted based on the frame sections Ft−1, Ft, and Ft+1 in order to prevent deterioration of liquid crystal. The data driving circuit 120 may generate data voltages inverted by each frame section unit based on an invert signal.

The data driving circuit 120 may include a driving chip 121 mounted on a flexible circuit board 122. The data driving circuit 120 may include a plurality of driving chips 121 and the flexible circuit board 122. The flexible circuit board 122 electrically connects the main circuit board MCB and the first substrate DS1. The driving chips 121 provide data signals to corresponding ones of the data lines DL1 to DLm.

A Tape Carrier Package (TCP) type data driving circuit 120 is illustrated as an example in FIG. 1. In one embodiment, the data driving circuit 120 may be on the non-display area NDA of the first substrate DS1 through a Chip-on-Glass (COG) method.

Figure 3:
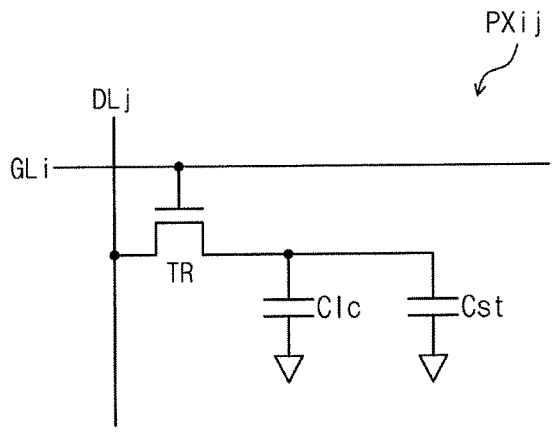
FIG. 3 illustrates an embodiment of a pixel.
Figure 4:
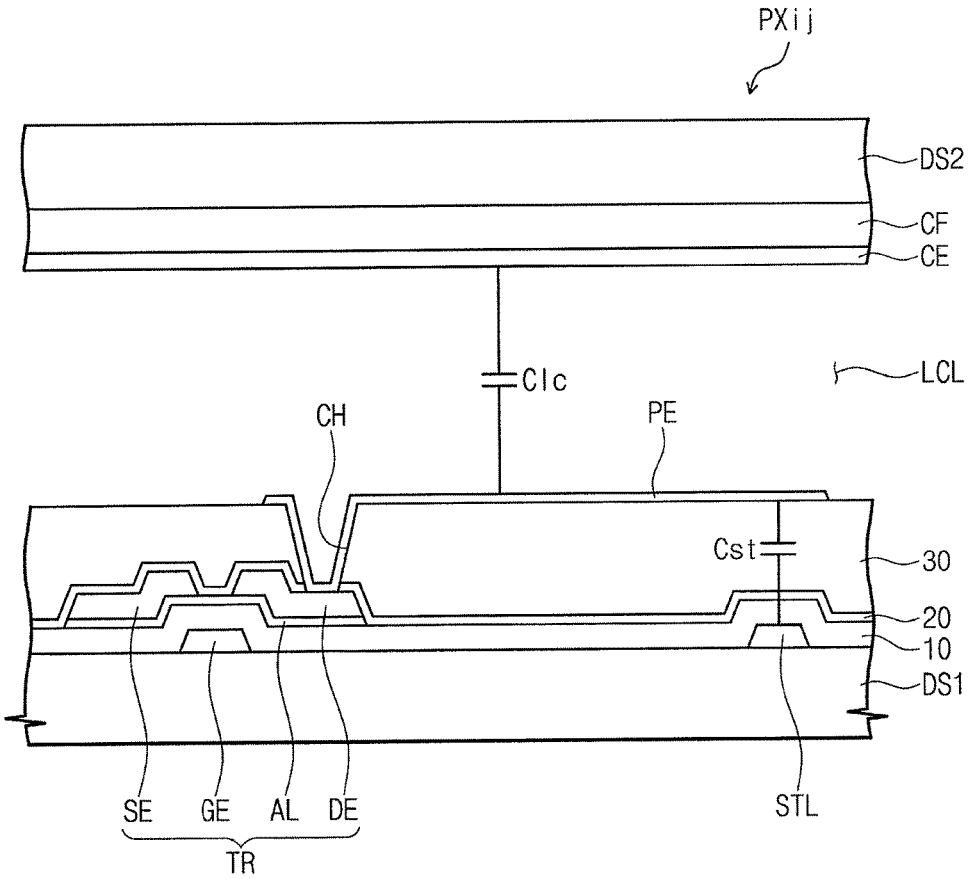
FIG. 4 illustrates another view of the pixel.

FIG. 3 illustrates an embodiment of a pixel PXij, which may be representative of the pixels PX11 to PXnm in the display device in FIG. 1. FIG. 4 illustrates a sectional view of the pixel.

Referring to FIG. 3, the PXij includes a pixel thin film transistor (pixel transistor) TR, a liquid crystal capacitor Clc, and a storage capacitor Cst. The transistor may be, for example, a thin film transistor. In one embodiment, the storage capacitor Cst may be omitted.

The pixel transistor TR is electrically connected to an ith gate line GLi and a jth data line DLj. The pixel transistor TR outputs a pixel voltage corresponding to a data signal from the jth data line DLj based on a gate signal from the ith gate line GLi.

The liquid crystal capacitor Clc is charged with a pixel voltage output from the pixel transistor TR. An arrangement of liquid crystal directors in a liquid crystal layer LCL (e.g., see FIG. 4) is changed according to a charge amount charged in the liquid crystal capacitor CLC. The light incident to a liquid crystal layer may be transmitted or blocked according to an arrangement of liquid crystal directors.

The storage capacitor Cst is connected in parallel to the liquid crystal capacitor Clc. The storage capacitor Cst maintains an arrangement of liquid crystal directors during a predetermined section.

Referring to FIG. 4, the pixel transistor TR includes a control electrode GE connected to the ith gate line GLi (e.g., FIG. 3), an activation part AL overlapping the control electrode GE, a first electrode SE connected to the jth data line DLj (e.g., FIG. 3), and a second electrode DE spaced apart from the first electrode SE.

The liquid crystal capacitor Clc includes a pixel electrode PE and a common electrode CE. The storage capacitor Cst includes the pixel electrode PE and a portion of a storage line STL overlapping the pixel electrode PE.

The ith gate line GLi and the storage line STL are on one surface of the first substrate DS1. The control electrode GE is branched from the ith gate line GLi. The ith gate line GLi and the storage line STL may include a metal (e.g., Al, Ag, Cu, Mo, Cr, Ta, Ti, etc.) or an alloy thereof. The ith gate line GLi and the storage line STL may have a multilayer structure and, for example, may include a Ti layer and a Cu layer.

A first insulating layer 10 covering the control electrode GE and the storage line STL is on one surface of the first substrate DS1. The first insulating layer 10 may include at least one of an inorganic material or an organic material. The first insulating layer 10 may be an organic layer or an inorganic layer. The first insulating layer 10 may have a multilayer structure and, for example, may include a silicon nitride layer and a silicon oxide layer.

The activation part AL overlapping the control electrode GE is on the first insulating layer 10. The activation part AL may include a semiconductor layer and an ohmic contact layer. The semiconductor layer is on the first insulating layer 10 and the ohmic contact layer is on the semiconductor layer.

The second electrode DE and the first electrode SE are on the activation part AL. The second electrode DE and the first electrode SE are spaced apart from each other. Each of the second electrode DE and the first electrode SE partially overlaps the control electrode GE.

A second insulating layer 20 covering the activation part AL, the second electrode DE, and the first electrode SE is on the first insulating layer 10. The second insulating layer 20 may include at least one of an inorganic material or an organic material. The second insulating layer 20 may be an organic layer or an inorganic layer. The second insulating layer 20 may have a multilayer structure and, for example, may include a silicon nitride layer and a silicon oxide layer.

The pixel transistor TR has a staggered structure in FIG. 1. In one embodiment, the pixel transistor TR may have a planar structure or another structure.

A third insulation layer 30 is on the second insulation layer 20, provides a flat surface, and may include, for example, an organic material.

The pixel electrode PE is on the third insulating layer 30. The pixel electrode PE is connected to the second electrode DE through a contact hole CH penetrating the second insulating layer 20 and the third insulating layer 30. An alignment layer covering the pixel electrode PE may be on the third insulating layer 30.

A color filter layer CF is on one surface of the second substrate DS2. A common electrode CE is on the color filter layer CF. A common voltage is applied to the common electrode CE. A common voltage and a pixel voltage have different values. An alignment layer covering the common electrode CE may be on the common electrode CE. Another insulating layer may be between the color filter layer CF and the common electrode CE.

The liquid crystal capacitor Clc includes a liquid crystal layer LCL between the pixel electrode PE and the common electrode CE. The storage capacitor Cst includes portions of the pixel electrode PE and the storage line STL, with the first insulating layer 10, the second insulating layer 20, and the third insulating layer 30 therebetween. The storage line STL receives a storage voltage having a different value from a pixel voltage. A storage voltage may have the same value as a common voltage.

A section of the pixel PXij illustrated in FIG. 3 is just one example. In one embodiment, at least one of the color filter layer CF or the common electrode CE may be on the first substrate DS1. For example, a liquid display panel according to one embodiment may include a pixel in a Vertical Alignment (VA) mode, a Patterned Vertical Alignment (PVA) mode, an in-plane switching (IPS) mode, a fringe-field switching (FFS) mode, or a Plane to Line Switching (PLS) mode.

Figure 5:
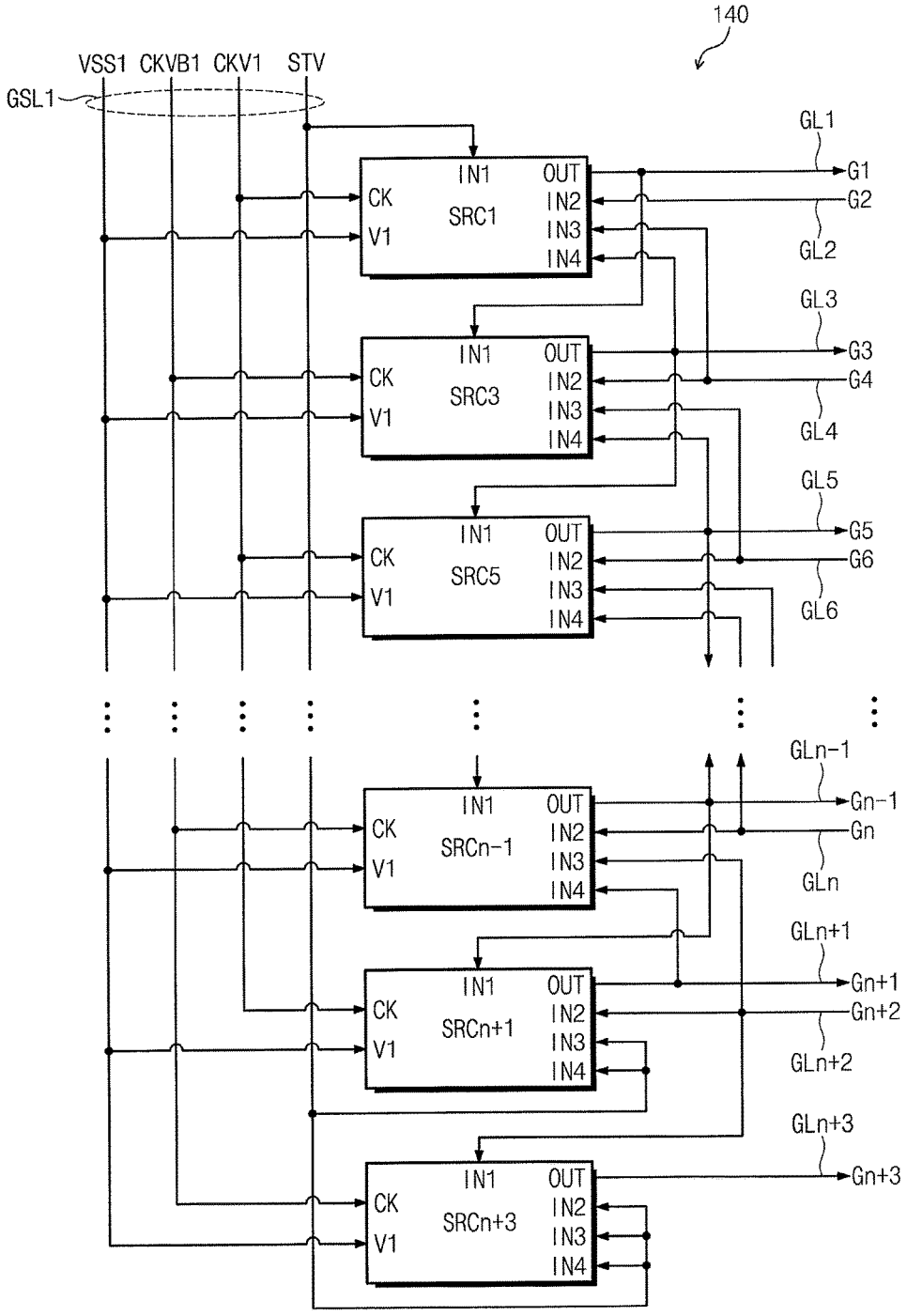
FIG. 5 illustrates an embodiment of a gate driving circuit.

FIG. 5 illustrates an embodiment of the first gate driving circuit 140 which includes a plurality of driving stages SRC1, SRC3, . . . , SRCn−1 and dummy driving stages SRCn+1 and SRCn+3. The driving stages SRC1, SRC3, . . . , SRCn−1 and dummy driving stages SRCn+1 and SRCn+3 may have, for example, a cascade relationship operating based to a gate signal output from a previous stage and a gate signal output from the next stage.

Each of the driving stages SRC1, SRC3, . . . , SRCn−1 receives a first clock signal CKV1, a second clock signal CKVB1, and a first ground voltage VSS1 from the driving controller 130 in FIG. 1. The driving stage SRC1 and the dummy driving stages SRCn+1 and SRCn+3 may also receive a start signal STV.

In one embodiment, the driving stages SRC1, SRC3, . . . , SRCn−1 may be respectively connected to the gate lines GL1, GL3, . . . , GLn−1. The driving stages SRC1, SRC3, . . . , SRCn−1 respectively provide gate signals G1, G3, . . . , Gn−1 to the gate lines GL1, GL3, . . . , GLn−1. In one embodiment, gate lines connected to the driving stages SRC1, SRC3, . . . , SRCn−1 may be odd gate lines among the all of the gate lines.

Each of the driving stages SRC1, SRC3, . . . , SRCn−1 and dummy driving stages SRCn+1 and SRCn+3 includes a first input terminal IN1, a second input terminal IN2, a third input terminal IN3, a fourth input terminal IN4, a gate output terminal OUT, a clock terminal CK, and a voltage terminal V1. The gate output terminal OUT of each of the driving stages SRC1, SRC3, . . . , SRCn−1 is connected to a corresponding one of the gate lines GL1, GL3, . . . , GLn−1. Gate signals from the driving stages SRC1, SRC3, SRCn−1 are provided to the GL1, GL3, . . . , GLn−1 through the gate output terminal OUT.

The gate output terminal OUT of each of the driving stages SRC1, SRC3, . . . , SRCn−1 is electrically connected to the first input terminal IN1 of the next driving stage of a corresponding driving stage.

The first input terminal IN1 of each of the driving SRC3, SRC5, . . . , SRCn−1 and the dummy driving stage SRCn+1 receives a gate signal of a previous driving stage of a corresponding driving stage. For example, the first input terminal IN1 of the k-th driving stage SRCk receives the gate signal Gk−2 of the (k−2)th driving stage SRCk−2. The first input terminal IN1 of the first driving stage SRC1 among the driving stages SRC1, SRC3, . . . , SRCn−1 receives a vertical start signal STV from the driving controller 130 in FIG. 1, instead of the gate signal of a previous driving stage.

The second input terminal IN2 of each of the driving stages SRC1, SRC3, . . . , SRCn−1 receives a gate signal of the second gate driving circuit 150 in FIG. 1. For example, the second input terminal IN2 of the k-th driving stage SRCk receives a gate signal Gk+1 output from the gate output terminal OUT of the (k+1)th driving stage SRCk+1. The second input terminal IN2 of the dummy driving stage SRCn+3 receives a vertical start signal STV.

The third input terminal IN3 of each of the driving stages SRC1, SRC3, . . . , SRCn−1 receives a gate signal of the second gate driving circuit 150 in FIG. 1. For example, the third input teiminal IN3 of the k-th driving stage SRCk receives a gate signal Gk+3 output from the gate output terminal OUT of the (k+3)th driving stage SRCk+3. The third input terminal IN3 of each of the dummy driving stages SRCn+1 and SRCn+3 receives a vertical start signal STV.

The fourth input terminal IN4 of each of the driving stages SRC1, SRC3, . . . , SRCn−1 receives a gate signal of the next driving stage. For example, the fourth input terminal IN4 of the k-th driving stage SRCk receives a gate signal Gk+2 output from the gate output terminal OUT of the (k+2)th driving stage SRCk+2. The fourth input terminal IN4 of each of the dummy driving stages SRCn+1 and SRCn+3 receives a vertical start signal STV.

The clock terminal CK of each of the driving stages SRC1, SRC3, . . . , SRCn−1 and dummy driving stages SRCn+1 and SRCn+3 receives one of the first clock signal CKV1 or the second clock signal CKVB1. The driving stages SRC1, SRC5, . . . , SRCn−3 among the driving stages SRC1, SRC3, . . . , SRCn−1 and the dummy driving stage SRCn+1 receive the first clock signal CKV1 and the driving stages SRC3, SRC7, . . . , SRCn−1 and the dummy driving stage SRCn+3 receive the second clock signal CKVB1. The first clock signal CKV1 and the second clock signal CKVB1 may have different phases. The first clock signal CKV1 and the second clock signal CKVB1 may have opposite phases.

The voltage terminal V1 of each of the driving stages SRC1, SRC3, SRCn−1 and dummy driving stages SRCn+1 and SRCn+3 receives a first ground voltage VSS1.

In one embodiment, each of the driving stages SRC1, SRC3, . . . , SRCn−1 may omit one of the first input terminal IN1, the second input terminal IN2, the third input terminal IN3, or the fourth input terminal IN4 and/or may include other terminals. For example, a voltage terminal for receiving the second ground voltage VSS2 may be included in addition to the voltage terminal V1.

Figure 6:
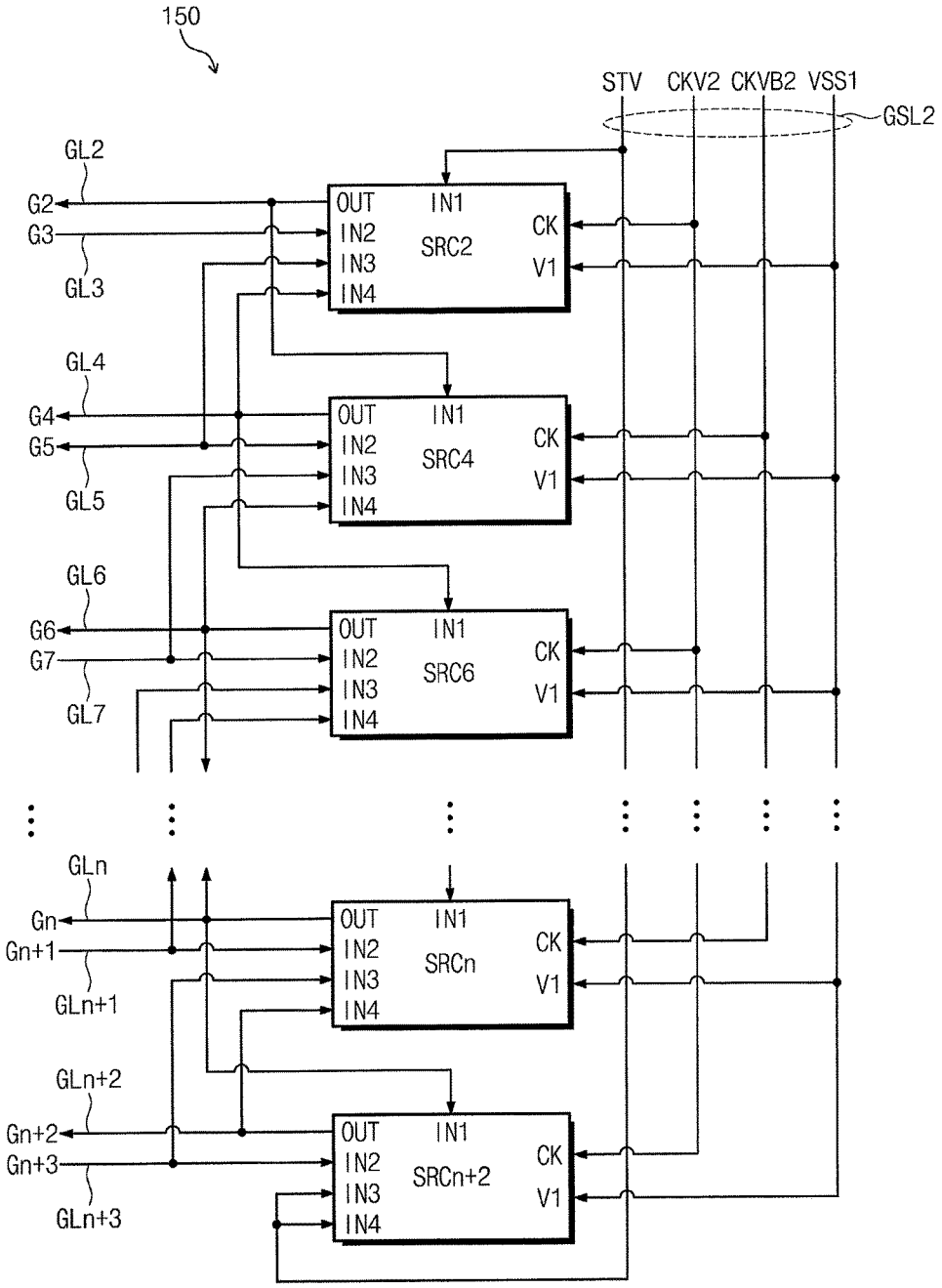
FIG. 6 illustrates an embodiment of another gate driving circuit.

FIG. 6 illustrates an embodiment of the second gate driving circuit 150 includes a plurality of driving stages SRC2, SRC4, . . . , SRCn and a dummy driving stage SRCn+2. The driving stages SRC2, SRC4, . . . , SRCn and the dummy driving stage SRCn+2 may have, for example, a cascade relationship that operates based on a gate signal from a previous stage and a gate signal from the next stage.

Each of the driving stages SRC2, SRC4, . . . , SRCn receives a third clock signal CKV2, a fourth clock signal CKVB2, and a first ground voltage VSS1 from the driving controller 130 in FIG. 1. The driving stage SRC2 and the dummy driving stage SRCn+2 may also receive a start signal STV.

The driving stages SRC2, SRC4, . . . , SRCn may be respectively connected to the gate lines GL2, GL4, . . . , GLn. The driving stages SRC2, SRC4, . . . , SRCn provide gate signals G2, G4, . . . , Gn to the gate lines GL2, GL4, . . . , GLn, respectively. According to an embodiment, gate lines connected to the driving stages SRC2, SRC4, . . . , SRCn may be even gate lines among the entire gate lines GL1 to GLn.

Each of the driving stages SRC2, SRC4, . . . , SRCn and the dummy driving stages SRCn+2 includes a first input terminal IN1, a second input terminal IN2, a third input terminal IN3, a fourth input terminal IN4, a gate output terminal OUT, a clock terminal CK, and a voltage terminal V1.

The gate output terminal OUT of each of the driving stages SRC2, SRC4, . . . , SRCn is connected to a corresponding gate line among the gate lines GL2, GL4, . . . , GLn. Gate signals from the driving stages SRC2, SRC4, . . . , SRCn are provided to the gate lines GL2, GL4, . . . , GLn through the gate output terminal OUT.

The gate output terminal OUT of each of the driving stages SRC2, SRC4, . . . , SRCn is electrically connected to the first input terminal IN1 of the next driving stage of a corresponding driving stage.

The first input terminal IN1 of each of the driving SRC4, SRC6, . . . , SRCn and the dummy driving stage SRCn+1 receives a gate signal of a previous driving stage of a corresponding driving stage. For example, the first input terminal IN1 of the k-th driving stage SRCk receives the gate signal Gk−2 of the (k−2)th driving stage SRCk−2. The first input terminal IN1 of the first driving stage SRC2 of the driving stages SRC4, SRC6, . . . , SRCn receives a vertical start signal STV from the driving controller 130 in FIG. 1, instead of the gate signal of a previous driving stage.

The second input terminal IN2 of each of the driving stages SRC4, SRC6, . . . , SRCn receives a gate signal of the first gate driving circuit 140 in FIG. 1. For example, the second input terminal IN2 of the k-th driving stage SRCk receives a gate signal Gk+1 output from the gate output terminal OUT of the (k+1)th driving stage SRCk+1.

The third input terminal IN3 of each of the driving stages SRC4, SRC6, . . . , SRCn receives a gate signal of the first gate driving circuit 140 in FIG. 1. For example, the third input terminal IN3 of the k-th driving stage SRCk receives a gate signal Gk+3 output from the gate output terminal OUT of the (k+3)th driving stage SRCk+3. The third input terminal IN3 of the dummy driving stage SRCn+2 receives a vertical start signal STV.

The fourth input terminal IN4 of each of the driving stages SRC2, SRC4, . . . , SRCn receives a gate signal of the next driving stage. For example, the fourth input terminal IN4 of the k-th driving stage SRCk receives a gate signal Gk+2 output from the gate output terminal OUT of the (k+2)th driving stage SRCk+2. The fourth input terminal IN4 of the dummy driving stage SRCn+2 receives a vertical start signal STV.

The clock terminal CK of each of the driving stages SRC2, SRC4, . . . , SRCn and the dummy driving stage SRCn+2 receives one of the third clock signal CKV2 or the fourth clock signal CKVB2. The clock terminal CK of each of the driving stages SRC2, SRC6, . . . , SRCn−2 and the dummy driving stage SRCn+2 receives the clock signal CKV2. The clock terminal CK of each of the driving stages SRC4, SRC8, . . . , SRCn−2 receives the second clock signal CKVB1. The first clock signal CKV1 and the second clock signal CKVB1 may have different phases, e.g., opposite phases.

The voltage terminal V1 of each of the driving stages SRC2, SRC4, . . . , SRCn and the dummy driving stage SRCn+1 receives a first ground voltage VSS1.

In one embodiment, each of the driving stages SRC2, SRC4, . . . , SRCn may omit one of the first input terminal IN1, the second input terminal IN2, the third input terminal IN3, or the fourth input terminal IN4 and/or may include other terminals. For example, a voltage terminal may be included for receiving the second ground voltage VSS2 in addition to the voltage terminal V1.

Figure 7:
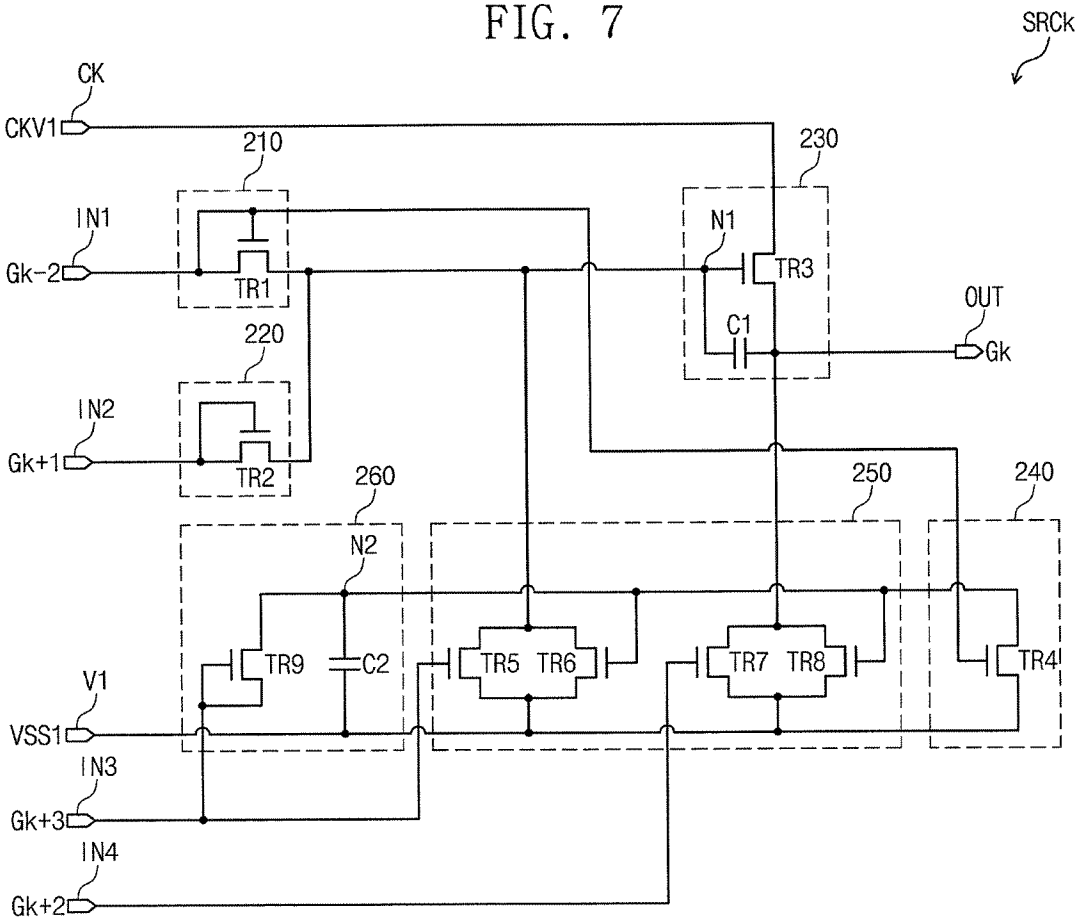
FIG. 7 illustrates an embodiment of a driving stage.

FIG. 7 illustrates an embodiment of a driving stage, which may correspond to the k-th driving stage SRCk (k is a positive integer greater than 1) among the driving stages SRC1, SRC3, . . . , SRCn−1 in FIG. 5. Each of the driving stages SRC1, SRC3, . . . , SRCn−1 in FIG. 5 may have the same circuit configuration as the k-th driving stage SRCk in FIG. 7. Each of the driving stages SRC2, SRC4, . . . , SRCn in FIG. 6 may have the same circuit configuration as the k-th driving stage SRCk in FIG. 7.

The driving stage SRCk in FIG. 7 may receive the first clock signal CKV1 through the clock terminal CK and may receive one clock signal corresponding to the driving stage SRCk among the second clock signal CKB1, the third clock signal CKV2, and the fourth clock signal CKVB2.

Referring to FIG. 7, the k-th driving stage SRCk includes a first input circuit 210, a second input circuit 220, an output circuit 230, a discharge circuit 240, a pull down circuit 250, and a hold circuit 260. The first input circuit 210 receives a (k−2)th gate signal Gk−2 from a (k−2)th stage SRCk−2. The second input circuit 220 receives a (k+2)th gate signal Gk+1 from a (k+1)th stage SRCk+1. The output circuit 230 outputs the first clock signal CKV1 as the k-th gate signal Gk based on a signal of the first node N1. The discharge circuit 240 discharges the second node N2 as the first ground voltage VSS1 based on the (k−2)th gate signal Gk−2 from the (k−2)th stage SRCk−2.

The pull down circuit 250 discharges the first node N1 as the first ground voltage V1 based on a signal of the second node N2 and the (k+3)th gate signal Gk+3 from the (k+3)th stage SRCk+3, and discharges the k-th gate signal Gk as the first ground voltage V1 based on a signal of the second node N2 and the (k+2)th gate signal Gk+2 from the (k+2)th stage SRCk+2.

The hold circuit 260 receives the (k+3)th gate signal Gk+3 from the (k+3)th stage SRCk+3, delivers the (k+3)th gate signal Gk+3 to the second node N2, and maintains a signal level of the second node N2 for a predetermined time.

A specific configuration example of the first input circuit 210, the second input circuit 220, the output circuit 230, the discharge circuit 240, the pull down circuit 250, and the hold circuit 260 is as follows. The first input circuit 210 includes a first input transistor TR1. The first input transistor TR1 includes a first electrode connected to the first input terminal IN1 for receiving the (k−2)th gate signal Gk−2, a second electrode connected to the first node N1, and a gate electrode connected to first input terminal IN1.

The second input circuit 220 includes a second input transistor TR2. The second input transistor TR2 includes a first electrode connected to the second input terminal IN2 for receiving the (k+1)th gate signal Gk+1 , a second electrode connected to the first node N1, and a gate electrode connected to the second input terminal IN2.

The output circuit 230 includes an output transistor TR3 and a capacitor C1. The output transistor TR3 includes a first electrode connected to a clock terminal CK for receiving a first clock signal CKV1, a second electrode connected to a gate output terminal OUT for outputting the k-th gate signal Gk, and a gate electrode connected to the first node N1. The capacitor C1 is connected between the first node N1 and the gate output terminal OUT.

The discharge circuit 240 includes a discharge transistor TR4. The discharge transistor TR4 includes a first electrode connected to the second node N2, a second electrode connected to the voltage terminal V1 for receiving the first ground voltage VSS1, and a gate electrode connected to the first input terminal IN1.

The pull down circuit 250 includes a first pull down transistor TR5 and a second pull down transistor TR6 to discharge the first node N1 as the first ground voltage VSS1, and a third pull down transistor TR7 and a fourth pull down transistor TR8 to discharge the k-th gate signal Gk as the first ground voltage VSS1.

The first pull down transistor TR5 includes a first electrode connected to the first node N1, a second electrode connected to the voltage terminal V1 for receiving the first ground voltage VSS1, and a gate electrode connected to the third input terminal IN3 for receiving the (k+3)th gate signal Gk+3. The second pull down transistor TR6 includes a first electrode connected to the first node N1, a second electrode connected to the voltage terminal V1, and a gate electrode connected to the second node N2. The third pull down transistor TR7 includes a first electrode connected to the gate output terminal OUT for outputting the k-th gate signal Gk, a second electrode connected to the voltage terminal V1, and a gate electrode connected to the fourth input terminal IN4 for receiving the (k+2)th gate signal Gk+2. The fourth pull down transistor TR8 includes a first electrode connected to the gate output terminal OUT, a second electrode connected to the voltage terminal V1, and a gate electrode connected to the second node N2.

The hold circuit 260 includes a first hold transistor TR9 and a second capacitor C2. The first hold transistor TR9 includes a first electrode connected to the third input terminal IN3 for receiving the (k+3)th gate signal Gk+3, a second electrode connected to the second node N2, and a gate electrode connected to the third input terminal IN3. The second capacitor C2 is connected between the second node N2 and voltage terminal V1.

Figure 8:
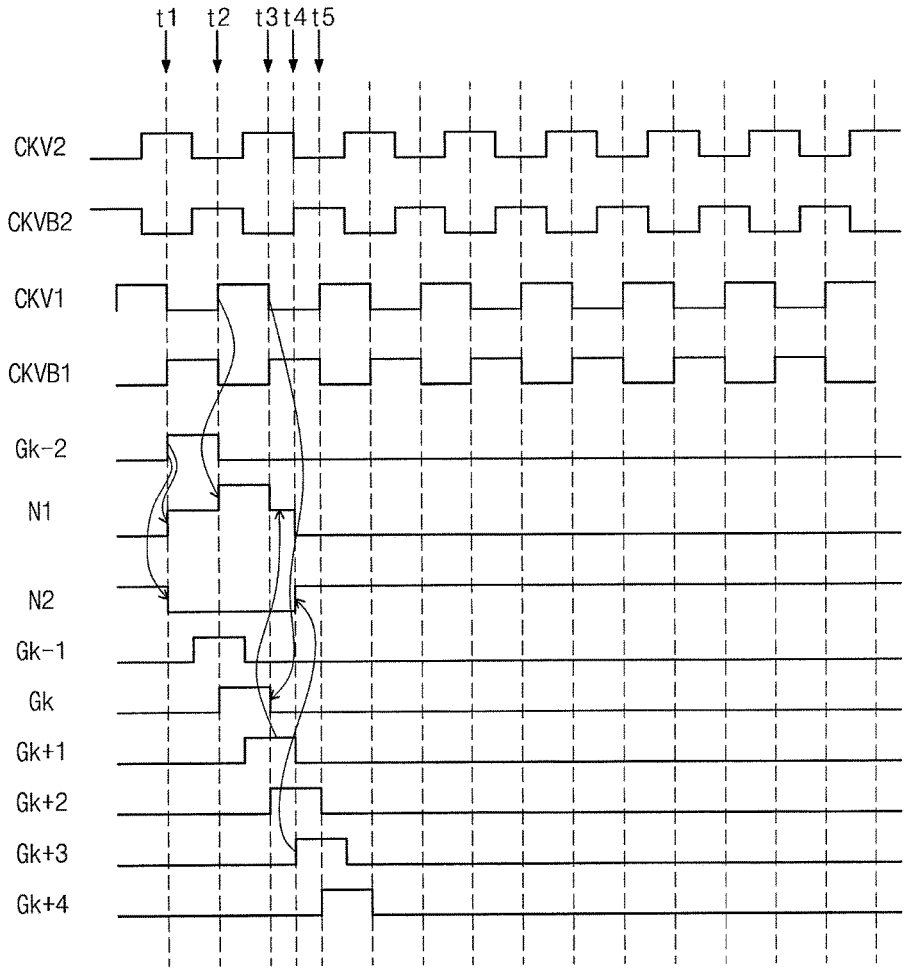
FIG. 8 illustrates an embodiment of signals for controlling the driving stage.

FIG. 8 illustrating an embodiment of signals for controlling operation of the driving stage in FIG. 7. Referring to FIGS. 7 and 8, at the first time point t1 that the (k−2)th gate signal Gk−2 of the (k−2)th driving stage SRCk−2 shifts to a high level, the first input transistor TR1 in the first input circuit 210 is turned on to pre-charge the first node N1 to a voltage level of the (k−2)th gate signal Gk−2. When the (k−2)th gate signal Gk−2 shifts to a high level, the discharge transistor TR4 in the discharge circuit 250 is turned on to discharge the second node N2 to the first ground voltage VSS1.

When the output transistor TR3 is turned on at the second time point t2 that the first clock signal CKV1 shifts to a high level, the first node N1 is boosted to a predetermined voltage level by the first capacitor C1. A high level of the first clock signal CKV1 is output as the k-th gate signal Gk through output transistor TR3.

Since the (k+1)th gate signal Gk+1 of the (k+1)th driving stage SRCk+1 has a high level at the third time point t3 that the first clock signal CKV1 shifts to a low level, the second input transistor TR2 is turned on to maintain the first node N1 at a predetermined pre-charge level. Since the output transistor TR3 maintains a turn on state while the first node N1 is maintained in a predetermined level, the k-th gate signal Gk may be discharged to a low level of the first clock signal CKV1 through the output transistor TR3. When the (k+2)th gate signal Gk+2of the (k+2)th driving stage SRCk+2 shifts to a high level at the third time point t3, the third pull down transistor TR7 is turned on to discharge the k-th gate signal Gk to the first ground voltage VSS1.

When the (k+3)th gate signal Gk+3 of the (k+3)th driving stage SRCk+3 shifts to a high level at the fourth time point t4, the hold transistor TR9 in the hold circuit 260 is turned on to increase the second node N2 to a level of the (k+3)th gate signal Gk+3. When the signal level of the second node N2 is a high level, the second pull down transistor TR6 and the fourth pull down transistor TR8 are turned on. Therefore, the first node N1 and the k-th gate output terminal Gk may be discharged to the first ground voltage VSS1. Additionally, the first pull down transistor TR5 is turned on based on a high level of the (k+3)th gate signal Gk+3 to discharge the first node N1 as the first ground voltage VSS1.

Since the driving stage SRCk having such a configuration pulls down the k-th gate signal Gk as the first clock signal CKV1 through the output transistor TR3, the size of the third pull down transistor TR7 may be reduced or minimized. In one embodiment, the pull down circuit 250 may not include the third pull down transistor TR7.

When the (k+3)th gate signal Gk+3 of the (k+3)th driving stage SRCk+3 shifts to a high level, the second node N2 shifts to a high level. As the pull down operations of the second pull down transistor TR6 and the fourth pull down transistor TR8 are performed at the fourth time point t4 earlier than the fifth time point t5, it is possible to prevent malfunction caused by lowering of the discharge speed of the first node N1.

Also, using the second capacitor C2 in the hold circuit 260, the second node N2 may be maintained in a predetermined high level until the (k−2)th gate signal Gk−2 of the next frame shifts to a high level. Therefore, the first node N1 and the k-th gate output terminal Gk may be maintained stably at a level of the first ground voltage VSS1. Additionally, the driving stage SRCk having such a configuration does not form a current path between the first clock signal CKV1 and the first ground voltage VSS1. As a result, leakage current may be reduced or minimized, which may result in a reduction in power consumption.

Figure 9:
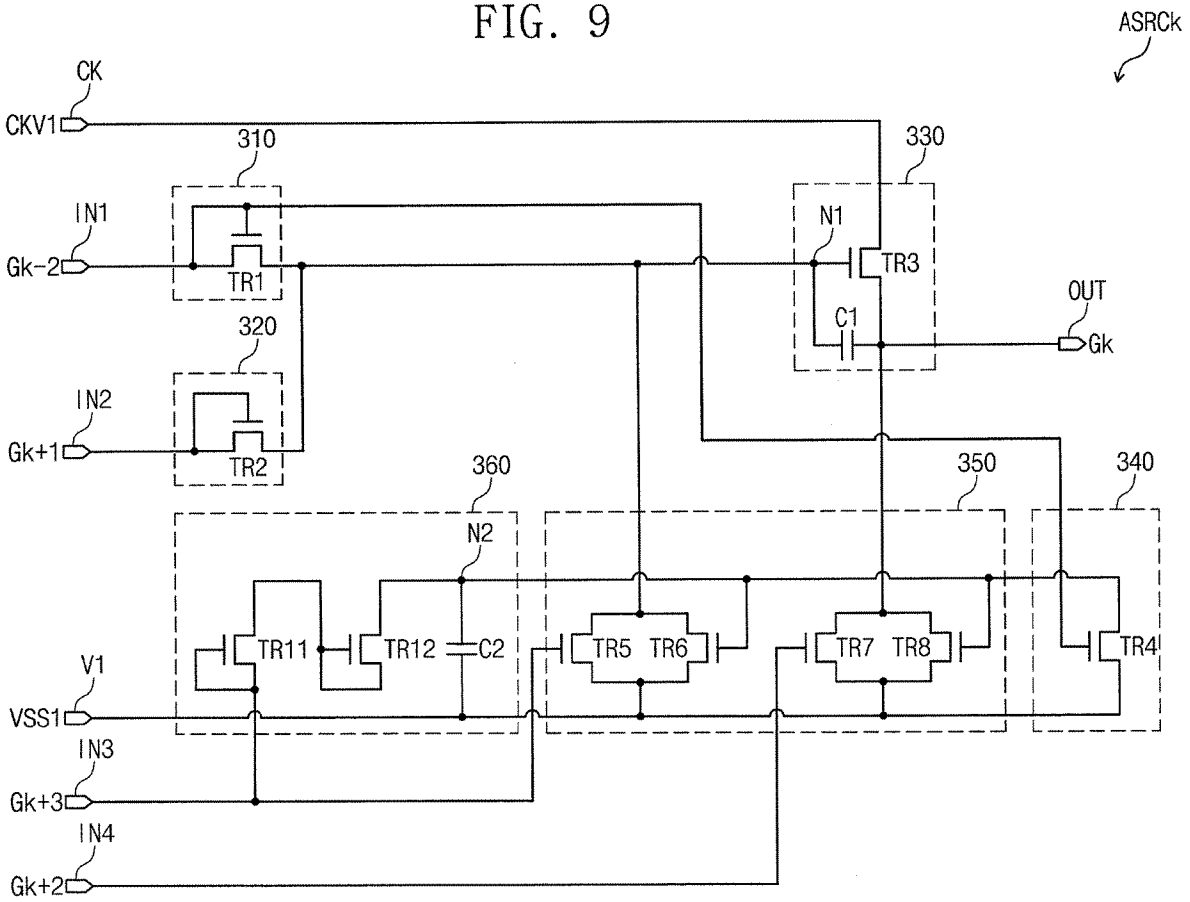
FIG. 9 illustrates another embodiment of a driving stage.

FIG. 9 illustrates another embodiment of a driving stage, which, for example, may correspond to a k-th driving stage ASRCk corresponding to a k-th driving stage SRCk (k is a positive integer greater than 1) among the driving stages SRC1, SRC3, . . . , SRCn−1 in FIG. 5. Each of the driving stages SRC1, SRC3, . . . , SRCn−1 in FIG. 5 may have the same circuit as the k-th driving stage ASRCk in FIG. 9. Each of the driving stages SRC2, SRC4, . . . , SRCn in FIG. 6 may have the same circuit as the k-th driving stage ASRCk in FIG. 9. The driving stage ASRCk in FIG. 9 may receive the first clock signal CKV1 through the clock terminal CK and may receive one clock signal corresponding to the driving stage ASRCk among the second clock signal CKB1, the third clock signal CKV2, and the fourth clock signal CKVB2.

Referring to FIG. 9, the k-th driving stage ASRCk includes a first input circuit 310, a second input circuit 320, an output circuit 330, a discharge circuit 340, a pull down circuit 350, and a hold circuit 360. The first input circuit 310, the second input circuit 320, the output circuit 330, the discharge circuit 340, and the pull down circuit 350 in FIG. 9 may have the same configuration as the first input circuit 210, the second input circuit 220, the output circuit 230, the discharge circuit 240, and the pull down circuit 250.

The hold circuit 360 includes a first hold transistor TR11, a second hold transistor TR12, and a second capacitor C2. The first hold transistor TR11 includes a first electrode connected to the third input terminal IN3 for receiving the (k+3)th gate signal Gk+3, a second electrode, and a gate electrode connected to the third input terminal IN3. The second hold transistor TR12 includes a first electrode connected to the second electrode of the first hold transistor TR11, a second electrode connected to the second node N2, and a gate electrode connected to the second electrode of the first hold transistor TR11. The second capacitor C2 is connected between the second node N2 and the voltage terminal V1.

When the first gate driving circuit 140 and the second gate driving circuit 150 in FIG. 1 operate for a long time, if a threshold voltage of the first hold transistor TR11 is changed, a current of the second node N2 may be discharged to the third input terminal IN3 through the first hold transistor TR11 while the (k+3)th gate signal Gk+3 is maintained in a low level. The signal level of the second node N2 may be maintained at a predetermined level by the second capacitor C2, but its voltage level may be lowered by leakage current. This deteriorates the reliability of the first gate driving circuit 140 and the second gate driving circuit 150.

As shown in FIG. 9, by connecting the first hold transistor TR11 and the second hold transistor TR12 in series in the hold circuit 360, it is possible to reduce or minimize the current of the second node N2 from leaking to the third input terminal IN3, even when the threshold voltages of the first hold transistor TR11 and the second hold transistor TR12 are changed.

When a clock signal shifts to a high level, since a gate driving circuit having such a configuration does not form a current path between a clock signal and a ground voltage, it is possible to prevent power consumption increase by leakage current. Additionally, since a gate signal is pulled up through an output transistor and also a gate signal is pulled down as a low level of a clock signal through an output transistor, the size of a third pull down transistor may be reduced.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The stages, drivers, circuit boards, and other processing features of the disclosed embodiments may be implemented in logic which, for example, may include hardware, software, or both. When implemented at least partially in hardware, the stages, drivers, circuit boards, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the stages, drivers, circuit boards, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A gate driving circuit, comprising:

a plurality of stages to provide gate signals to gate lines of a display panel, wherein a k-th stage (k being a natural number greater than or equal to 2) from among the stages includes:

a first input circuit to receive a (k−2)th gate signal from a (k−2)th stage and deliver the (k−2)th gate signal to a first node;

a second input circuit to receive a (k+1)th gate signal from a (k+1)th stage and deliver the (k+1)th gate signal to the first node;

an output circuit to output a first clock signal as a k-th gate signal based on a signal of the first node;

a discharge circuit to discharge a second node as a voltage based on the (k−2)th gate signal;

a pull down circuit to discharge the first node as the voltage based on a signal of the second node and a (k+2)th gate signal from a (k+2)th stage and discharge the k-th gate signal as the voltage based on the signal of the second node and a (k+2)th gate signal from a (k+2)th stage; and a hold circuit to receive a (k+3)th gate signal from a (k+3)th stage, deliver the (k+3)th gate signal to the second node, and maintain a signal level of the second node for a predetermined time.

2. The gate driving circuit as claimed in claim 1, wherein the first input circuit includes a first input transistor which includes a first electrode connected to a first input terminal to receive the (k−2)th gate signal, a second electrode connected to the first node, and a gate electrode connected to the first input terminal.

3. The gate driving circuit as claimed in claim 1, wherein the second input circuit includes a first input transistor comprising a first electrode connected to a second input terminal to receive the (k+1)th gate signal, a second electrode connected to the first node, and a gate electrode connected to the second input terminal.

4. The gate driving circuit as claimed in claim 1, wherein the discharge circuit includes a discharge transistor which includes a first electrode connected to the second node, a second electrode connected to a voltage terminal to receive the voltage, and a gate electrode connected to a first input terminal to receive the (k−2)th gate signal.

5. The gate driving circuit as claimed in claim 1, wherein the pull down circuit includes:

a first pull down transistor including a first electrode connected to the first node, a second electrode connected to a voltage terminal to receive the voltage, and a gate electrode connected to a third input terminal for receiving the (k+3)th gate signal;

a second pull down transistor including a first electrode connected to the first node, a second electrode connected to the voltage terminal, and a gate electrode connected to the second node;

a third pull down transistor including a first electrode connected to a gate output terminal to output the k-th gate signal, a second electrode connected to the voltage terminal, and a gate electrode connected to a fourth input terminal to receive the (k+2)th gate signal; and a fourth pull down transistor including a first electrode connected to the gate output terminal a second electrode connected to the voltage terminal, and a gate electrode connected to the second node.

6. The gate driving circuit as claimed in claim 1, wherein the hold circuit includes:

a hold transistor including a first electrode connected to a third input terminal to receive the (k+3)th gate signal, a second electrode connected to the second node, and a gate electrode connected to the third input terminal; and a capacitor connected to the second node and a voltage terminal to receive the voltage.

7. The gate driving circuit as claimed in claim 1, wherein the hold circuit includes:

a first hold transistor including a first electrode connected to a third input terminal to receive the (k+3)th gate signal, a second electrode, and a gate electrode connected to the third input terminal;

a second hold transistor including a first electrode connected to the second electrode of the first hold transistor, a second electrode connected to the second node, and a gate electrode connected to the second electrode of the first hold transistor; and a capacitor connected to the second node and a voltage terminal to receive the voltage.

8. A display device, comprising:

a display panel including a plurality of pixels respectively connected to a plurality of gate lines and a plurality of data lines;

a gate driving circuit including a plurality of stages to output gate signals to the gate lines; and a data driving circuit to drive the data lines, wherein a k-th stage among the stages (k is a positive integer greater than 1) includes:

a first input circuit to receive a (k−2)th gate signal from a (k−2)th stage and deliver the (k−2)th gate signal to a first node;

a second input circuit to receive a (k+1)th gate signal from a (k+1)th stage and deliver the (k+1)th gate signal to the first node;

an output circuit to output a first clock signal as a k-th gate signal based on a signal of the first node;

a discharge circuit to discharge a second node as a voltage based on the (k−2)th gate signal;

a pull down circuit to discharge the first node as the voltage based on a signal of the second node and a (k+2)th gate signal from a (k+2)th stage and discharge the k-th gate signal as the voltage based on the signal of the second node and a (k+2)th gate signal from a (k+2)th stage; and a hold circuit to receive a (k+3)th gate signal from a (k+3)th stage, deliver the (k+3)th gate signal to the second node, and maintain a signal level of the second node for a predetermined time.

9. The display device as claimed in claim 8, wherein the gate driving circuit includes:

a first gate driving circuit including a plurality of first stages to output the gate signals to a first group of gate lines among the gate lines; and a second gate driving circuit including a plurality of second stages to output the gate signals to a second group of gate lines among the gate lines.

10. The display device as claimed in claim 9, wherein the first gate driving circuit and the second gate driving circuit are at different sides of the display panel.

11. The display device as claimed in claim 9, wherein:

a first group of first stages among the first stages are to operate based on a first clock signal, and a second group of first stages among the first stages are to operate based on a second clock signal complementary to the first clock signal.

12. The display device as claimed in claim 11, wherein:

a group of second stages among the second stages are to operate based on a third clock signal, a second group of second stages among the second stages are to operate based on a fourth clock signal complementary to the third clock signal; and the first clock signal and the second clock signal have different phases.

13. The display device as claimed in claim 8, wherein the first input circuit includes a first input transistor which includes a first electrode connected to a first input terminal to receive the (k−2)th gate signal, a second electrode connected to the first node, and a gate electrode connected to the first input terminal.

14. The display device as claimed in claim 8, wherein the second input circuit includes a first input transistor which includes a first electrode connected to a second input terminal to receive the (k+1)th gate signal, a second electrode connected to the first node, and a gate electrode connected to the second input terminal.

15. The display device as claimed in claim 8, wherein the discharge circuit includes a discharge transistor which includes a first electrode connected to the second node, a second electrode connected to a voltage terminal to receive the voltage, and a gate electrode connected to a first input terminal for receiving the (k−2)th gate signal.

16. The display device as claimed in claim 8, wherein the pull down circuit includes:

a first pull down transistor including a first electrode connected to the first node, a second electrode connected to a voltage terminal to receive the voltage, and a gate electrode connected to a third input terminal for receiving the (k+3)th gate signal;

a second pull down transistor including a first electrode connected to the first node, a second electrode connected to the voltage terminal, and a gate electrode connected to the second node;

a third pull down transistor including a first electrode connected to a gate output terminal to output the k-th gate signal, a second electrode connected to the voltage terminal, and a gate electrode connected to a fourth input terminal to receive the (k+2)th gate signal; and a fourth pull down transistor including a first electrode connected to the gate output terminal, a second electrode connected to the voltage terminal, and a gate electrode connected to the second node.

17. The display device as claimed in claim 8, wherein the hold circuit includes:

a hold transistor including a first electrode connected to a third input terminal to receive the (k+3)th gate signal, a second electrode connected to the second node, and a gate electrode connected to the third input terminal; and a capacitor connected to the second node and a voltage terminal to receive the voltage.

18. The display device as claimed in claim 8, wherein the hold circuit includes:

a first hold transistor including a first electrode connected to a third input terminal for receiving the (k+3)th gate signal, a second electrode, and a gate electrode connected to the third input terminal;

a second hold transistor including a first electrode connected to the second electrode of the first hold transistor, a second electrode connected to the second node, and a gate electrode connected to the second electrode of the first hold transistor; and a capacitor connected to the second node and a voltage terminal to receive the voltage.

* * * * *